United States Patent [19]

Flagg

[11] 4,415,895

[45] Nov. 15, 1983

[54] WELL LOGGING DATA TRANSMISSION SYSTEM

[75] Inventor: Jack J. Flagg, Houston, Tex.

[73] Assignee: Dresser Industries, Inc., Dallas, Tex.

[21] Appl. No.: 233,355

[22] Filed: Feb. 11, 1981

[51] Int. Cl.[3] ..... G01V 1/40; G01V 3/13; E21B 29/02

[52] U.S. Cl. ..... 340/856; 340/857; 181/103; 324/339

[58] Field of Search ..... 340/856, 853, 857, 860, 340/858, 870; 324/339; 181/102, 103, 104

[56] References Cited

U.S. PATENT DOCUMENTS

| | | | |
|---|---|---|---|
| 3,356,990 | 12/1967 | Sloughter | 340/856 |
| 3,707,700 | 12/1972 | Lafont | 340/858 |
| 3,773,109 | 11/1973 | Eberline | 340/853 |
| 3,991,611 | 11/1976 | Marshall et al. | 340/857 |
| 4,028,660 | 6/1977 | Pitts, Jr. | 340/853 |
| 4,123,744 | 10/1978 | Ingram | 181/104 |
| 4,296,412 | 10/1981 | Mastner | 340/870.19 |
| 4,319,192 | 3/1982 | Chemali et al. | 324/339 |

OTHER PUBLICATIONS

"Bidirectional Telemetry for Downhole Well Logging," by Thomas S. Matthews, *Petroleum Engineer*, Sep. 1977.

*Primary Examiner*—Nelson Moskowitz

*Attorney, Agent, or Firm*—Richard M. Byron; Patrick H. McCollum

[57] ABSTRACT

A telemetering system provides improved cable utilization and bi-directional digital communication between a logging sonde and surface electronics over a single balanced transmission line of a multi-conductor logging cable, with significant signal crosstalk reductions. Receiver circuitry downhole decodes pulses delivered on the line from a surface logic generator which fire transmitter-receiver pairs of an acoustic logging tool in an order defined by the pulses. A PCM transmitter in the sonde thereafter samples data generated by other logging instruments, encodes this information into digital data frames, and transmits the data on the same line to a surface PCM receiver. Circuitry limits surface and downhole receiver response to PCM transmitter and logic generator pulses, respectively. A center tap of the same transmission line also provides for simultaneous noise-free transmission of sensitive low level signals such as remote surface potential and the like to the sonde.

19 Claims, 7 Drawing Figures

TELEMETRY TRANSMITTER/ RECEIVER
3
18
52
9
17
15
13
11
27
26
POWER
38
28
LINE DRIVER
36
30
DIGITAL MULTIPLEXER
SWITCH
40
41
39
SWITCH
ACOUSTIC LOGIC DECODER
45
43
46
44
33
N/C
32
42
31
150
COUNTER
151
34
A/D CONVERTER
153
ANALOG MULTIPLEXER
101
103
105
107
152
FROM FIG. 3
50
50A
52
25
9

RESISTIVITY LOGGING ELECTRONICS
TELEMETRY RECEIVER/ TRANSMITTER
FILTER
CHOPPER
A5
A6
A3
A4
A7
A2
A1
KROD
IOD
± DC VOLT.
FILTER
CHOPPER
±DC V
TO FIG. 2
V2D
VRD
VRS
PSD
FILTER f1
FILTER f2
V2S
V1D
V1S
f1 + f2
I1D
I1S
LOGGING INSTRUMENT X
RADIOACTIVITY LOGGING INSTRUMENT Y
ACOUSTIC TRANSMITTER/ RECEIVER INSTRUMENT
53 B1B2'
54 A1 A2'
55 M2 M2'
56 M1 M1'
57 A0

FIG. 5
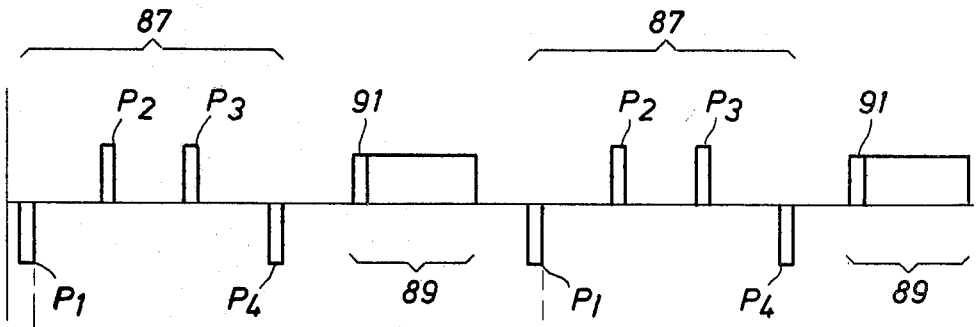
FIG. 6
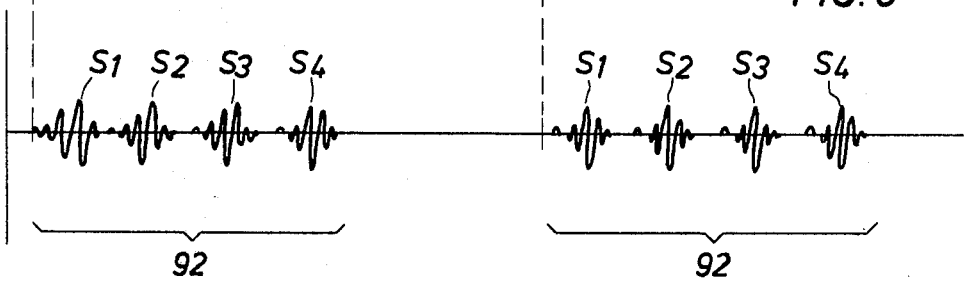
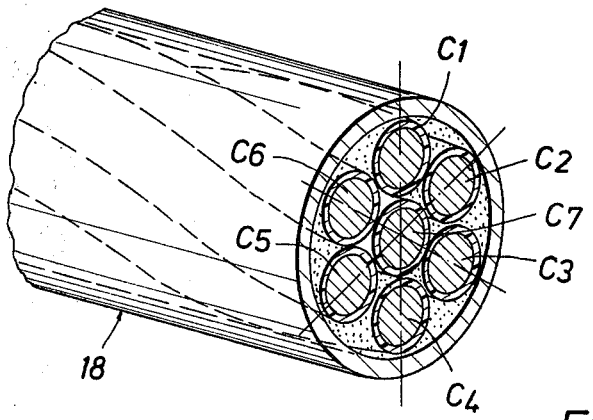
FIG. 7

WELL LOGGING DATA TRANSMISSION SYSTEM

FIELD OF THE INVENTION

This invention relates to a system for communicating logging information between surface electronics located at the well site and electronics disposed within a logging sonde. More particularly, the invention relates to methods and apparatus for establishing a bi-directional digital data telemetry link between the sonde and the surface over a single balanced conductor pair of a multi-conductor logging cable having improved noise immunity and cable utilization.

DESCRIPTION OF THE PRIOR ART

It is conventional practice in the search for petroleum substances residing in subsurface earth formations to drill boreholes into such formations, and to survey the earth materials along the borehole length to determine locations therein where oil or gas may be recovered. These boreholes are normally surveyed or logged by passing a sonde through the borehole which contains devices capable of measuring the borehole parameters of interest, and thereafter transmitting these measurements to the surface for analysis.

In the early history of well logging, such measurements were relatively simple, being limited by factors such as logging tools, surface recovery equipment, and the fact that sophisticated data was not required for the discovery of shallow or large deposits. However, as oil and gas exploration became more expensive, due to such factors as the deeper wells being drilled and new oil bearing formations becoming scarcer and harder to locate, a need arose for better information regarding such formations, both in terms of reliability and quantity of data. Consequently, as the art of well logging progressed, logging tools and surface equipment have become far more complex, such that massive amounts of raw logging information are being generated in the sonde for transmission to the surface. Moreover, due to recently developed sophisticated logging data analysis techniques, the need for still greater quantities of more reliable logging data has been created.

An example of the well logging systems which have been developed for simultaneously generating and transmitting to the surface these complex measurements from a plurality of logging tools may be seen depicted and described in U.S. patent application Ser. No. 949,592, filed Oct. 10, 1978, now abandoned. Not only have such systems increased the number of parameters being simultaneously measured in order to avoid the expense and unreliability associated with the prior art technique of making multiple passes through the borehole, but the rate at which these measurements are available for processing has also increased tremendously. This may be due to a number of factors, including the faster rate at which the sonde is now caused to traverse the borehole, the increasingly smaller increments of borehole which must be sampled, and the statistical nature of some of the more modern logging tools.

With the advent of microprocessing computers locatable in the sonde for receiving sophisticated information and commands from the surface, even further demands have now been placed upon the communication link between the sonde and the surface regarding information density, the need for reliability, freedom from noise, distortion, attenuation, and the like. Moreover, as the depth of borehole investigation increases with attendant increases in temperature, the increased length and temperature of the logging cables over which the information is transmitted aggrevates problems of attenuation, noise, and distortion.

For example, in order to achieve the aforementioned high information density rates required by modern logging operations, digital pulse code telemetry schemes have been used requiring pulses with relatively short rise times. However, such pulses contain high frequency components which are severely attenuated and distorted by the increased resistance and related time constant thus associated with the longer logging cables disposed in higher temperature environments. This attenuation is often so severe as to "smear" pulses to the extent that they are virtually unrecognizable to receiving equipment.

One solution to the problem has been to perform the logging operation at a slower rate, thus reducing the information density. This solution, however, is fraught with many difficulties, not the least of which is the expense associated with the down time of the drilling rig operation while the well is being logged. Yet another solution to the problem of bi-directional telemetry of high density information in a logging operation has been to increase the effective band width of the communication link by means of a multi-conductor logging cable wherein information may be simultaneously transferred from the sonde to the surface or vice versa in two or more channels each associated with its respective conductor.

Unfortunately, the telemetry demands of modern logging operation are so severe that even this multi-conductor logging cable solution has proved seriously inadequate. For example, it has been found that there is a constraint to the number of such channels or conductors within a cable which may be practically employed. Factors giving rise to this constraint include the fact that cable weight limitations may limit the maximum cable diameter, the face that as more conductors or channels are placed in a cable of given cross-section, the conductor diameter will decrease giving rise to increased time constants and the distortion problems associated therewith, and of extreme importance, the fact that as more data channels are employed side by side, increased risk of parasitic interference or "crosstalk" between channels is encountered due to well-known capacitive coupling effects.

The later problem of crosstalk is of particular significance when the nature of the signals being carried by the logging cable is considered. Specifically, and typically, some form of power is being supplied to the sonde such as 60-cycle AC on one such conductor which is notorious for delivering spurious 60-cycle hum into other data channels or conductors. Still further, for example, powerful acoustic trigger logic pulses on the order of 10 volts in magnitude have been transmitted downhole to command conventional acoustic logging transmitters and receivers to fire in an appropriate sequence which are also notorious for crosstalking into other sensitive information channels in the telemetry link between the sonde and the surface. This problem is particularly acute with respect to very sensitive, low level signals such as a measurement of remote earth potential on the order of millivolts which is to be communicated to the sonde from the surface. Such signals in the past simply could not withstand the degradation caused by simultaneous occurrence of acoustic trigger pulses or other such signals being transmitted in adjacent conductors.

Attempts have further been made to improve the amount of data carried on a monocable by time sharing or multiplexing data from a plurality of sources in an attempt to avoid the hereinbefore noted crosstalk problem associated with multiconductors. However, such an approach limits the information density due to the limitations inherent in availability of only one conductor pair. While a monocable may carry multiplexed PCM data from the sonde, typically due to concern over the aforementioned crosstalk problems, multi-conductor cables carrying other signals at the same time have not been used. It has thus not heretofore been appreciated that bi-directional communication on a conductor pair in a multi-conductor logging cable may be effected to improve information density and cable utilization while, at the same time, reducing crosstalk associated with such multi-conductor cable usage and while further avoiding the problems associated with connecting both a surface and subsurface transmitter-receiver pair on the same conductor pair.

In addition to the multiplexing approach to the problem of maximizing information density on a logging cable, yet another solution to the problem has employed center taps or "phantom" conductors known in the art to superimpose an additional signal on a conductor pair. Typically, however, the information content of the additional signal has been of such a character as to be relatively immune to crosstalk through the application of filtering techniques and the like. For example, such a signal which may be typically carried by a center tap would include a relatively large DC potential which slowly varies as a function of a caliper measurement of borehole diameter originating at the sonde. Due to the nature of such a slowly varying high magnitude signal, it was relatively easy to isolate alternating current crosstalk therefrom through filtering techniques well known in the art. However, more sensitive and lower level signals, such as the hereinbefore noted measurement of earth potential at a remote location were thought to require the notoriously noise-free center conductor of a multi-conductor cable for transmission from the surface to the sonde, thus dedicating this cable to such a signal and precluding its use for transmitting other sensitive signals such as acoustic signature wave forms, for example.

Due to the fact that a single coaxial monocable severely limits the amount of information which may be transferred between the surface and the logging sonde, an urgent need existed for methods and apparatus for employing a multi-conductor logging cable to maximize the transmission of bi-directional pulsed logging information from the surface to the sonde and vice versa. Moreover, the need further existed for such bi-directional communication on one conductor pair of a multi-conductor logging cable whereby problems of the prior art in adjacent signal crosstalk and isolation of respective downhole and surface transmitter/receiver pairs on the same line were effectively reduced or eliminated. More specifically, with respect to the isolation problem, a telemetry system was required by the industry which could permit transmission of high level signals such as acoustic trigger pulses in an efficient cable utilization format whereby lower level signals might also be simultaneously transmitted without such crosstalk interference from these pulses, 60-cycle power and the like, and which, at the same time, would provide another conductor in the cable available for carrying still further noise-sensitive signals which would also be immune to these interfering signals.

The disadvantages hereinbefore noted of previous well logging telemetry systems are overcome with the present invention, and novel methods and apparatus are provided for effecting bi-directional digital telemetry between the surface and a subsurface logging sonde through a multi-conductor cable whereby problems of interference between low and high level signals carried simultaneously in adjacent conductors are reduced as well as problems of interference between two transmitter-receiver pairs being connected to the same conductor for such bi-directionality, and whereby, still further, configuration of the conductor utilization provides for improvements in the amount of noise sensitive information which may be carried on the cable.

SUMMARY OF THE INVENTION

In the methods and apparatus of the present invention, well site circuitry located at the surface adjacent the borehole is provided, as well as a logging sonde, and a multi-conductor logging cable interconnected therebetween, all of which, including the manner of connection, will be hereinafter described in greater detail.

The logging cable employed is preferably of a cylindrical multi-conductor type well known in the industry. Typically, such cable consists of an insulated center conductor, around which are symetrically wrapped in spiral or helical fashion six additional insulated conductors, numbered consecutively C1–C6 for reference purposes, the center conductor being referred to as C7 (see FIG. 7). These conductors are enclosed in a cylindrical outerprotective sheath or armor. A cross-section of the cable taken at a point along its length would thus reveal an end portion of the center conductor C7 disposed in the center of the cross-section, and end portions of the six outer conductors C1–C6 evenly spaced on a circle defined by their centers adjacent the circumference and outer sheath of the cross-section.

Referring more particularly to the surface circuitry of the instant invention, a suitable source of power, typically 60 Hz AC, delivers power to the circuitry in the sonde to be hereinafter discussed, such power being, by convention, delivered on the conductor pair C4–C6 (see FIG. 7). At both ends of the cable secondary windings of pulse transformers located respectively at the surface and in the sonde will preferably be connected, (again for reference purposes) across conductors C2 and C5. These conductors will form the balanced transmission line or conductor pair for bi-directional transmission of pulsed digital logging data in a manner to be described. It will be appreciated that these conductors C2 and C5, as well as the center conductor C7, will lie on a line perpendicular to and bisecting a line whose end points are defined by the centers of conductors C4 and C6, the significance of which will shortly be apparent.

The surface circuitry will further be provided with pulse encoder circuitry means for encoding information which is desired to be transmitted downhole to the sonde in the conventional digital form of pulses. While the scope of the invention is not limited to such an embodiment, typically such pulses may be positive or negative-going rectangular pulses from an acoustic logic generator on the order of 10 volts in magnitude, the purpose of which, for example, may be to instruct a conventional acoustic logging tool in the sonde as to when particular acoustic transmitters or receivers located therein are to be enabled. Pulses from such a generator will thence be delivered to suitable line driver circuitry which, in turn, will impedance match and amplify these pulses in a conventional manner for delivery to the primary of the aforementioned surface pulse transformer. It will be noted that, due to the transformer coupling between the primary and secondary of the surface pulse transformer, upon delivery of these information pulses to the transformer, correlative pulses will thus be transmitted downhole on conductors C2 and C5 to the secondary of the downhole pulse transformer.

The surface circuitry of the subject invention will further have provided a pulse code modulation sync detector circuit electrically connected across a portion of the primary windings of the surface pulse transformer. This detector will examine incoming pulse trains originating from either the aforementioned acoustic logic generator through the line driver as well as pulses being sent up conductors C2 and C5 which are coupled to the surface pulse transformer primary through the secondary winding which is directly connected to conductors C2 and C5.

When a preselected digital pulse pattern or code word of ones and zeros has been received and decoded by the sync detector, all subsequent pulses for a preselected time interval thereafter appearing on the primary will be passed through the detector to an appropriate pulse code modulation receiver. This receiver will be adapted to decode the digital pulse information arriving after the preselected code word and transfer this information to suitable peripheral recording and display devices located at the well site.

It will thus be appreciated that if the sync detector is thus caused to pass pulses to the PCM receiver only for a fixed time interval after receipt of the synchronizing code word by the sync detector, and if this code word is generated in the sonde immediately prior to the transmission of a frame of digital logging data derived in the sonde and transmitted during this preselected time interval over conductors C2 and C5, that the net effect is that the surface PCM receiver will only receive digital pulses originating from the sonde. It will discriminate or not receive and decode pulses also appearing on the surface pulse transformer primary at a different time which originate from the acoustic logic generator. In this manner, the surface PCM receiver will be prevented from erroneously decoding pulse information from the acoustic logic generator mistakenly as if it was logging data information originating in the sonde.

The well logging method and apparatus of the present invention is preferably of the depth-dependent type described and depicted in U.S. patent application Ser. No. 949,592, filed Oct. 10, 1978 and entitled "Integrated Well Logging System and Method" although there is no intention to so limit the scope thereof. In such a system, logging measurements are derived by instruments in the sonde at discrete and preselected borehole depth intervals in response to a depth-dependent command signal transmitted to the sonde over the logging cable from sonde depth-sensing apparatus at the surface.

Accordingly, in the subject invention a suitable depth encoder circuit may be provided for monitoring the traversal of the logging cable over a sheave wheel as the sonde traverses the borehole. At preselected angular movements of the wheel functionally related to such movement of the sonde within the borehole, pulses are generated by the encoder which may be utilized to instruct other circuitry at the surface to generate command signals for delivery to the sonde which will thus occur and correspond to the desired depth intervals at which measurements are to be derived and/or delivered to the surface from the sonde.

Thus, in one particular embodiment of the invention, these depth pulses from the encoder will be delivered to the previously mentioned acoustic logic generator which, in response thereto, will generate acoustic logic pulses for delivery on conductors C2–C5 to the sonde. These acoustic logic pulses, it will be recalled, instruct conventional acoustic transmitters and receivers in the sonde to be fired in response thereto. Since the presence of these pulses at the sonde correspond in time to the delivery of depth encoder pulses to the acoustic logic generator (which in turn were generated in response to preselected movements of the sonde as previously described), it may readily be seen that the downhole acoustic transmitters and receivers will thus be constrained to operate and generate acoustic logging data at preselected depth intervals controlled by the depth encoder pulses. It will further be seen, in the more general case, that other such pulses in addition to acoustic logic command pulses may be sent to the sonde to instruct circuitry in the sonde to perform still other functions such as transmitting data or making other logging measurements at such preselected depth intervals defined by the encoder pulses.

Finally, with respect to the surface circuitry in the particular embodiment noted having acoustic logging equipment associated therewith, there may be provided at the surface an acoustic receiver which will receive and deliver to peripheral recording and display devices, conventional acoustic signatures detected by acoustic receivers within the sonde and delivered to the surface acoustic receiver preferably over the center conductor C7.

Referring now more particularly to the downhole circuitry disposed within the sonde at the other end of the logging cable, a pulse transformer will first be provided, the secondary of which is connected across the conductors C2 and C5 which are serving as the bi-directional digital telemetry link between the surface and sonde circuitry. Signals which are received by the primary of the transformer through transformer coupling from the secondary may then preferably be delivered to acoustic logic decoder circuitry through a switch, to be controlled in a fashion hereinafter described. The purpose of the logic decoder circuitry is to decode or scan incoming pulse trains from the pulse transformer to detect occurrence of a definite preselected sequence of pulses. For example, the decoder may be designed so as to look only for the occurrence of a pulse train comprised of a negative-going pulse followed by two positive pulses and a final negative pulse, wherein the first negative-going pulse is preceded only by a previous negative pulse.

Such a pulse train may correspond, for example, to the pulses generated at the surface by the acoustic logic generator circuitry and delivered downhole over conductors C2 and C5 to the acoustic logic decoder. Thus the decoder may be programmed to only be responsive to this preselected pulse train delivered from the surface circuitry. While in the preferred embodiment discussed the pulse train which the logic decoder is designed to detect is that of the acoustic logic pulses described, it will be appreciated that in the more general case such a decoder may be designed to detect the occurrence of virtually any preselected incoming pulse train or code from the surface for purposes of controlling functions in the sonde other than generation of acoustic logging data, e.g., for triggering the derivation of other well logging measurements from other tools.

When the logic decoder has detected that the preselected pulse train has arrived (which corresponds to a unique command signal such as the one described), the decoder will deliver a conventional sequence of enabling commands known in the prior art to acoustic transmitters and receivers within the sonde. Thus, using the convention that "T" stands for a transmitter, "R" for a receiver, and the subscript refers to a particular receiver or transmitter, such transmitters and receivers may be caused to fire sequentially in response to the commands in the order $T_1R_2$, $T_1R_1$, $T_2R_1$, and $T_2R_2$, the acoustic signatures received by each receiver being delivered to the surface as received over conductor C7.

Still referring to the downhole circuitry, as more particularly described in the aforementioned patent application Ser. No. 949,592, other logging instruments, both analog and digital, may be provided for making measurements of other well logging parameters such as natural gamma ray counts, borehole resistivity, and the like. Outputs of such analog instruments may be delivered to a suitable analog multiplexer which delivers sequential samples of their measurements to an analog to digital converter for conversion to digital form. The digitized samples are then delivered to a digital multiplexer along with measurements from digital instruments. One such digital measurement may, for example, be a digitized measurement of radioactivity count rates corresponding to natural gamma rays incident upon the sonde. This digitized measurement, derived by an appropriate transducer and digital counter, is thereafter delivered to the digital multiplexer.

It will be recalled that a code or "sync" word will be generated in the sonde by a sync generator (not shown) and delivered to the surface prior to each transmission of a frame of digitized logging data. The purpose of the word is to permit the surface PCM receiver circuitry to discriminate logging data from acoustic trigger pulses as previously described. In one particular embodiment of the invention, this word may be comprised of 16 digital ones in order to distinguish this word from the acoustic trigger pulse word. The digital word thus output from such a sync generator may then preferably be delivered to the aforementioned digital multiplexer along with the digitized analog measurements and other digital measurements just described.

The function of the digital multiplexer is to prepare a "frame" of sequential digital data comprised of a plurality of channels for transmission to the surface over conductors C2–C5. The first such channel will be comprised of the previously mentioned digital sync word, followed sequentially by each of the digitized analog measurements and other digital measurements in whatever order may be desired.

The digital multiplexer will be provided with an enabling input signal transferred from the acoustic logic decoder. This signal will be delivered to the multiplexer in response to the detection by the logic decoder of the acoustic trigger pulse train. The purpose of the signal is to instruct the multiplexer that all acoustic signatures have been generated and transmitted to the surface and that it is now time to sample the other instruments' measurements, construct the PCM frame correlative thereto, and transmit it to the surface.

The multiplexer will thus then deliver a sampling signal to the various other logging instruments commanding them to deliver their current logging information to the analog multiplexer in the case of analog instruments for conversion to digital form, or to the digital multiplexer in the case of digital logging information from the digital instruments such as the radiation counter or the like, said multiplexer thereafter operating as described to organize the data into a suitable digital frame which is delivered to the PCM transmitter for transmission to the surface.

As with the surface-generated pulses being delivered downhole, a conventional line driver is provided in the sonde for receiving the frame of digital data from the digital multiplexer which, in like manner to the surface line driver, will be connected to the primary of the downhole pulse transformer, and serves to amplify the digital data for transmission to the surface and to match impedances between the digital multiplexer and the pulse transformer primary. A normally open switch will be provided in series between the output of the line driver and the primary of the downhole pulse transformer, and a normally closed switch provided between said primary and the input to the acoustic logic decoder. It will be noted that with such a configuration of switches, acoustic trigger pulses appearing on the primary will thus be delivered to the acoustic logic decoder through the normally closed switch for decoding, and the subsurface line driver will thus be isolated from the transformer due to the normally open switch.

However, when the digital multiplexer has thus constructed the frame of digital data as previously described for transmission to the surface, it will also generate a command signal delivered to both switches, instructing a normally open switch to close for a preselected time interval corresponding to the time the PCM frame will be transmitted, and further instructing the normally closed switch to open circuit for this time interval. In this manner, the line driver will thus be connected to the transformer, and the decoder will be isolated from the PCM data appearing on the primary during transmission, thus preventing the acoustic decoder from possibly decoding PCM data erroneously as an accoustic pulse train.

Connected in parallel across each of the respective surface and sonde pulse transformer secondaries will be two high precision equal value resistors wired in series, the junction of each pair of said resistors being provided with a center tap conductor. Alternatively, this center tap conductor may be connected to the electrically centermost winding of each of the secondaries in a conventional center tap fashion well known in the art. The surface center tap conductor may have impressed upon it any low level noise susceptible potential, such as the aforementioned remote earth surface potential, and thus may correspondingly lead to a suitable earth potential probe mounted within the earth formation adjacent the borehole.

The corresponding centertap conductor in the sonde, which will thus have this potential impressed thereupon, may lead to circuitry which may require the value of this potential at the sonde. For example, in the case of resistivity logging, such a potential is frequently required by the circuitry within the sonde utilized for making such measurements. It will be noted that the sensitive remote potential is thus being carried on the centertap or "phantom" conductor of a balanced transmission line or conductor pair C2–C5, which lies on the line bisecting the aforementioned line between the conductors C4 and C6, (which may carry noise inducing signals such as power and the like). Moreover, it will be apparent that the sensitive potential carried on the center tap is also carried on the identical balanced conductor pair C2–C5, which simultaneously carries yet other signals having noise inducing characteristics, e.g. PCM data and high level acoustic logic pulses. In this manner, it will be appreciated that the low level signal carried on the centertap will enjoy minimal noise interference from both other such signals carried on conductors C2–C5, as well as those carried on conductors C4–C6, and thus the desired noise immunity of the sensitive signal on the center tap will be achieved.

Still further, it will be appreciated that the center conductor C7, which is notoriously noise-free, is thus free to transmit other such sensitive signals, said conductor not being required to be dedicated to the romote potential. It will also be appreciated that because the conductor C7 has been located equidistant from each of the balanced pair of conductors C2–C5 and C4–C6, all of which are carrying noise inducing signals, the continued integrity of conductor C7 as being noise-free, and thus available for other sensitive signals is maintained.

Accordingly, it is a feature of the present invention to provide an improved bi-directional digital well logging data telemetry system between well site and the logging sonde.

It is another feature to provide a system for improved bi-directional digital telemetry of well logging data simultaneously with other logging data over a multi-conductor logging cable.

It is a further feature of the present invention to provide for improved noise immunity between well logging data transmitted simultaneously over a plurality of logging cable conductors.

It is a further particular feature of the present invention to provide for improved noise immunity of signals on a first conductor of a logging cable from control pulses carried simultaneously over an adjacent conductor in said cable.

It is another feature of the present invention to provide methods and apparatus for improving the information density capability of multi-conductor logging cables.

These and other features and advantages will become apparent from the following detailed description, wherein reference is made to the figures in the accompanying drawings.

IN THE DRAWINGS

FIG. 5 is a timing diagram depicting the relative occurrence of signals appearing on the logging cable of the present invention.

FIG. 6 is another pictorial representation of signals appearing on a logging conductor of the present invention.

FIG. 7 is a pictorial representation of a portion of the logging cable of the present invention.

DETAILED DESCRIPTION

Figure 1:
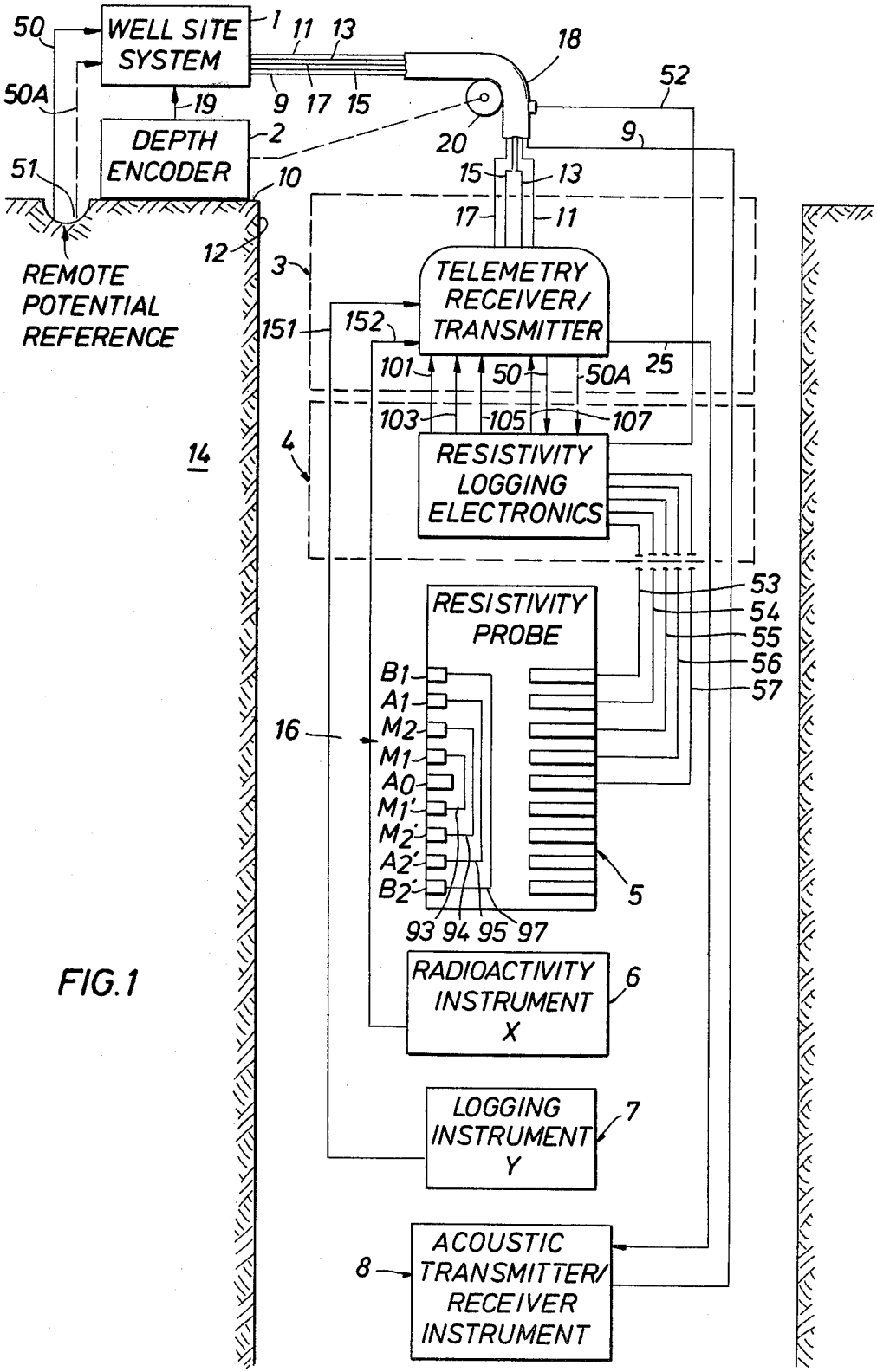
FIG. 1 is a simplified functional representation of an embodiment of the present invention.

Referring now to the drawings, FIG. 1 illustrates a portion of the earth's surface 10 into which a borehole 12 has been drilled, thereby penetrating the subsurface formation 14. Disposed within the borehole is a subsurface instrument 16 which is adapted to be raised and lowered therein by means of a multi-conductor logging cable 18. Surface apparatus includes a cable drum 20 onto which the logging cable 18 is wound or from which it is unwound, when the instrument 16 is caused to traverse the borehole 12. Additionally, the surface apparatus includes a well site system 1 connected to logging cable 18 through drum 20. The power means for driving drum 20 as well as a measuring wheel used to indicate the depth of the logging instrument 16 in borehole 12 by measuring the playout of cable 18 are both conventional and therefore not shown.

Still referring to FIG. 1, the subsurface instrument 16 includes a telemetry receiver/transmitter referred to generally as the telemetry section 3, which serves to receive signals communicated from the well site system 1 over cable 18, and to distribute them to their respective various logging instruments which in the embodiment depicted include a resistivity probe 5, a conventional acoustic logging instrument 8, and instruments for measuring any other desired parameters, shown generally as logging instruments x and y at 6 and 7, respectively. The telemetry section 3 also serves to receive measurement data from these instruments 5–7 and to transmit them to the surface.

Also located at the surface 10 is a depth encoder 2 which monitors movement of the drum 20 corresponding to movement of the cable 18, and thus to correlative movements of the subsurface sonde 16. The encoder 2 generates digital words from these movements corresponding to discrete sonde 16 depths as the sonde 16 traverses the borehole 12 which are delivered as depth interrupt signals 19 to the well site system 1. The well site system 1 then will utilize these indications of sonde 16 depth for purposes of sending command signals down the borehole 12 over cable 18 to command the logging instruments 5–8 to derive data or transfer it in response thereto to telemetry section 3 on a depth dependent basis, or to cause telemetry section 3 to transfer its data to the surface, again on a depth dependent basis in a manner to be described.

It is but one feature of the present invention to transfer relatively sensitive low level signals (on the order of millivolts, such as measurements of surface earth potential at reference 51) to the sonde 16 simultaneously with bi-directional transmission of noise-inducing data such as digital PCM data or large magnitude (on the order of ±ten volts) acoustic trigger pulses with novel methods and apparatus, whereby impairment of such low level signals is significantly reduced.

One logging measurement which utilizes such sensitive signals measures various resistivities of the formation 14, and is known in the industry generally as a "dual laterolog" measurement. Many methods and apparatus for making such resistivity measurements are known in the art and not considered a part of this invention, one particular method and apparatus being hereinafter described for purposes of completeness with reference to FIG. 3 wherein it may be seen how the need for transferring sensitive signals such as the remote potential reference 51 relates thereto. More detail regarding construction and operation of such a resistivity system may be had with reference to copending patent application Ser. No. 966,292 entitled "Dual Focused Resistivity Logging Method and Apparatus", filed Dec. 4, 1978, issued Aug. 4, 1981 as U.S. Pat. No. 4,282,486.

However, it should be appreciated that the method and apparatus herein described for transmitting such sensitive signals is considered to be of general application to any logging measurements, and the invention should not thus be considered as limited in any way to applications involving only small signals such as remote potential signals or involving only resistivity logging measurements.

Description will be given of a resistivity logging tool with reference to resistivity logging electronics 4, resistivity probe 5, and details thereof with reference to FIG. 3, a more detailed description will first be given of the particular methods and apparatus whereby signals, are transferred to the well site system 1 by telemetry section 3 and received therefrom. In doing so, reference will be made in more detail to FIG. 2.

Figure 3:
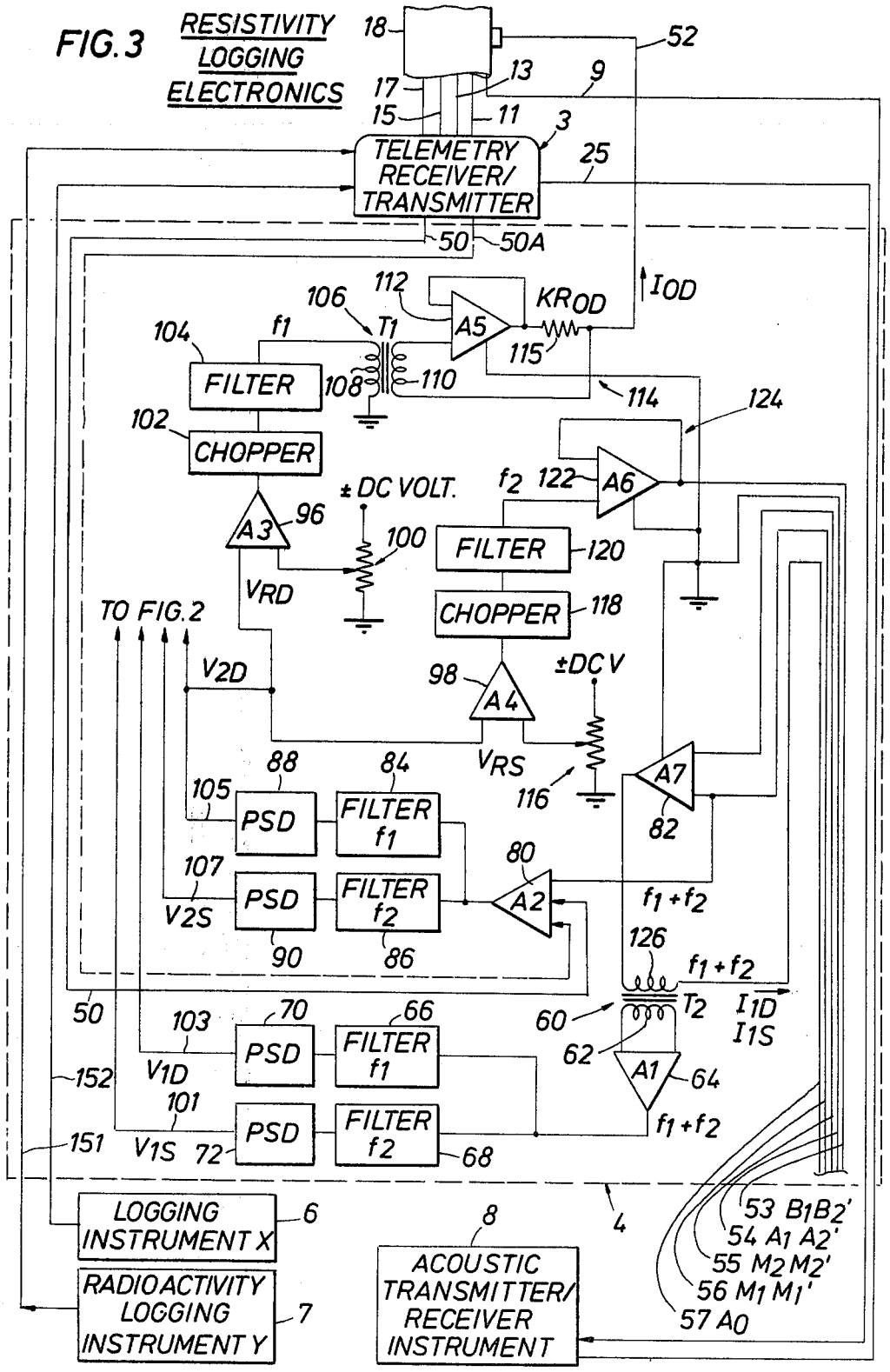
FIG. 3 is another more detailed representation of a portion of the downhole circuitry of the present invention represented in FIG. 1.

Description will then be given of the operation of a typical resistivity logging tool with reference to resistivity logging electronics 4, resistivity probe 5, and details thereof with reference to FIG. 3.

Figure 4:
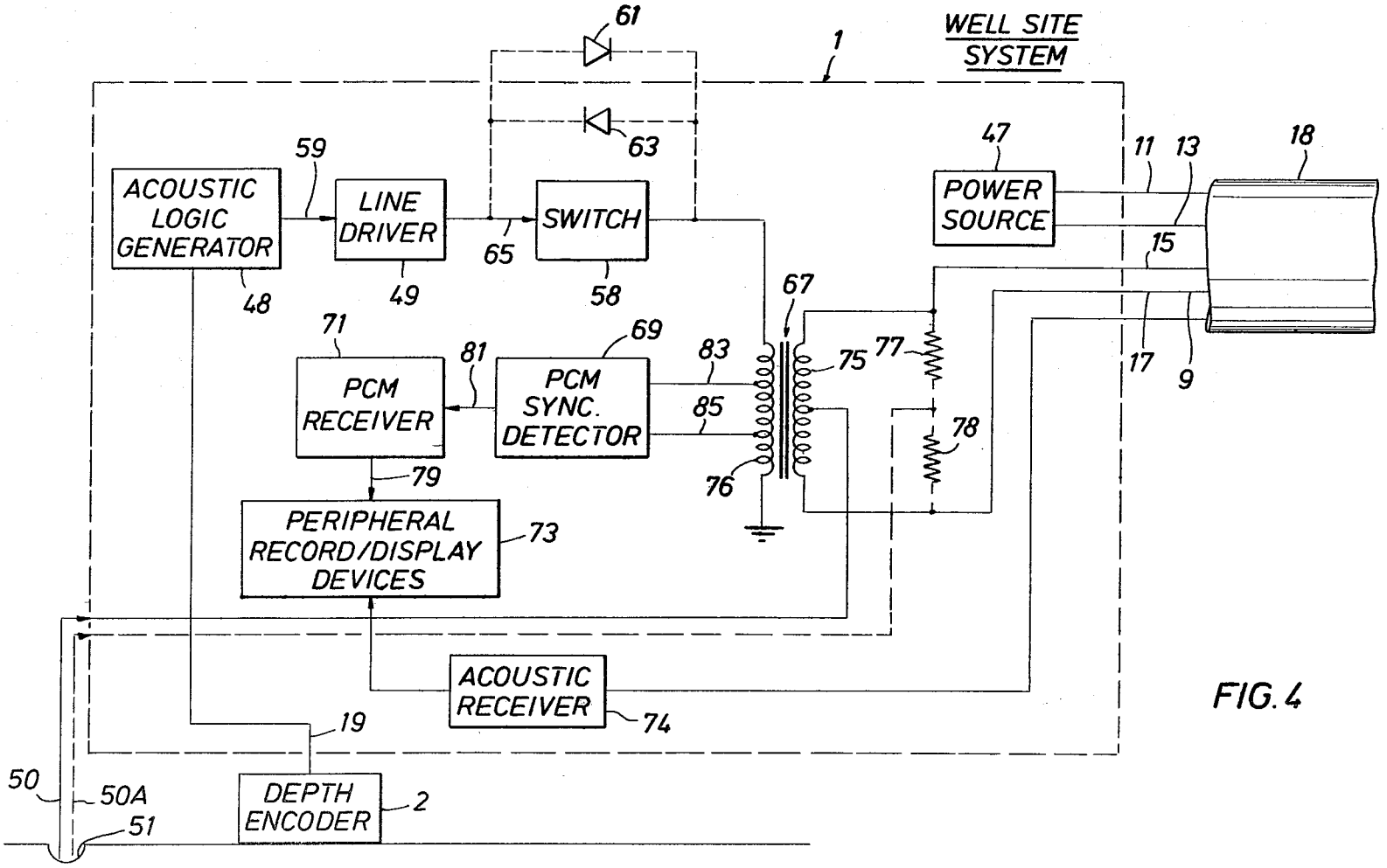
FIG. 4 is a more detailed representation of the surface circuitry of the present invention adjacent the borehole and depicted in FIG. 1.

Following such a description, a more detailed description of the well site system 1 circuitry will be had with reference to FIG. 4. In particular, a more detailed description will be made, in like manner to description of the telemetry section 3, of how the well site system 1 receives data from telemetry section 3 and delivers data thereto.

Figure 2:
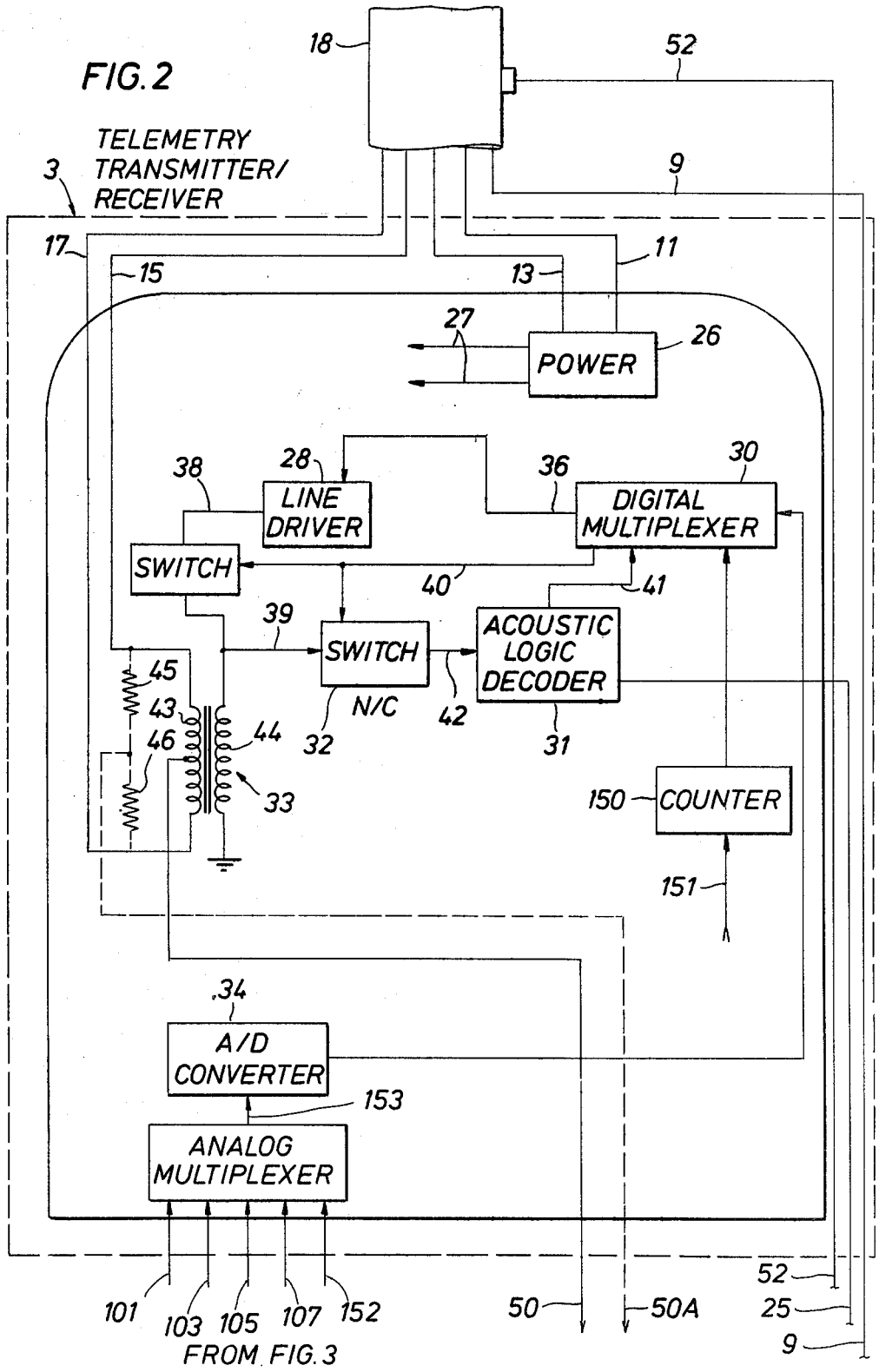
FIG. 2 is a more detailed representation of a portion of the downhole circuitry of FIG. 1 of the present invention.

Referring now to the downhole circuitry depicted in FIG. 2, as with the well site system 1, there will be seen a pulse or line transformer 33 having a secondary 43 and primary winding 44. Pulse trains such as 87 in FIG. 5 will be received on telemetry conductors 15–17, delivered to the secondary 43, and by transformer coupling, thereafter delivered from primary 44 as acoustic logic signal 39 to a normally closed switch 32, and thence on conductor 42 to appropriate acoustic logic decoder circuitry 31.

The decoder circuitry 31 is designed to detect when a pulse train such as 87, comprised of a negative going pulse P1, followed by two positive pulses P2–P3, and a next negative pulse P4 have been delivered to it on conductor 42 preceded by a prior negative pulse. This pulse train 87 serves as a code or identifying signature indicating that the time has occurred for an acoustic tool firing sequence. Because the pulse train 87 will be generated when the sonde 16 is at preselected depth intervals in response to the depth encoder 2, the resulting pulse train 87 will thus cause the derivation of acoustic measurements by the acoustic instrument 8 at these preselected depth intervals.

In response to the pulses P1–P4, an acoustic logic command signal 25 will be generated and delivered to the acoustic instrument 8 causing the transmitters and receivers contained therein to be enabled or fired in a preselected sequence already described. After each such firing of the transmitter, a correlative acoustic signature such as S1–S4 at 92 depicted in FIG. 6 will be generated and transmitted on the acoustic signature conductor 9 to the surface. At a predetermined time interval after the occurrence of the last pulse P4 in the pulse train 87 a PCM enable signal 41 is delivered from decoder 31 to a digital multiplexer 30. The purpose of of this enable signal 41 is to instruct the multiplexer 30 to acquire all digital data which is to be transmitted to the surface 10 and to deliver it to the well site system 1 prior to receipt of the next acoustic logic pulse train 87, in a manner to be described.

Referring now to FIGS. 2 and 3, analog measurements from such analog instruments as the outputs of 101, 103, 105 and 107 of the resistivity logging electronics 4, and outputs 152 from other such analog measurements as borehole width detected, for example by logging instrument x, will be delivered to an analog multiplexer for sequential sampling, the output 153 of which will then be delivered to an appropriate A/D converter 34 for sequential conversion into digital form. These sequentially digitized measurements will then be delivered to the digital multiplexer 30 for inclusion in the PCM data frame.

It will be appreciated that logging measurements corresponding to events rather than analog voltages (such as count rates of natural gamma radiation incident upon the sonde 16) may also be digitized and delivered to the digital multiplexer 30 for inclusion in the PCM frame. Thus, again referring to FIGS. 2 and 3, it will be seen that a radioactivity logging instrument 7 may be provided for detecting arrival of gamma ray particles, signals 151 corresponding thereto being delivered to an appropriate counter 150. The counter 150 will periodically deliver digitized count rates of such gamma rays to the digital multiplexer 30. The purpose of the multiplexer 30 is to construct a frame of digital data comprised of a plurality of channels of ones and zeros, each of which corresponds to a measurement from its corresponding instrument. The frame of digital data thus compiled by the multiplexer 30 is thereafter delivered to the line driver 28 on multiplexer output 30 for transmission to the surface. A functional illustration of such a frame of data may be seen at 89 in FIG. 5.

The multiplexer 30, in addition, will precede this digital data by a sync channel or code word 91, generated by a sync generator circuit (not shown). The purpose of the sync generator is to allow the PCM detector 69 to detect that downhole PCM data follows and to discriminate such data from the hereinbefore described acoustic logic generator pulse train 87. In this manner, the PCM receiver 71 will have passed to it for decoding only downhole PCM data contained in signal 81, and will prevent receiver 71 from erroneously decoding the pulse train 87 as if it were downhole logging information.

When the mulitplexer 30 has thus generated a PCM data frame 89, it will generate an acoustic logic disable signal 40 which will cause the switch 32 to open circuit for a predetermined time interval dependent on the length of PCM frame 89. This signal 40 will also close a normally opened switch in series between the primary 44 and the output of the line driver 28 for the same time interval.

The multiplexer 30 will then deliver this PCM frame of data 89 as PCM signal 36 to the appropriate line driver 28, the purpose of which is to amplify the PCM signal 36 and to match the output impedance of the multiplexer 30 to the primary 44 of the transformer 33. The line driver output 38 will thereafter be connected through the normally open switch to the primary 44 of the transformer 33 so that the PCM frame 89 may be delivered, through transformer coupling, to the surface for decoding. It will now be noted that the purpose of opening the switch 32 prior to such transmission of the PCM frame 89 is to disable or prevent the acoustic logic decoder 31 from erroneously decoding this pulsed PCM data frame 89 as if it were acoustic logic pulses P1–P4, thus erroneously causing the acoustic instrument 8 to fire on PCM data.

The portion of the logging instrument 16 consisting of the resistivity logging electronics 4 and resistivity probe 5 will now be explained in greater detail. It will first be noted that an electrode system is distributed longitudinally along the length of a portion of instrument 16 and comprises a central electrode 57($A_O$) and four electrode pairs, ($M_1$—$M_1'$), ($M_2$—$M_2'$), ($A_1$—$A_2'$) and ($B_1$—$B_2'$) placed symmetrically about $A_O$ as indicated in FIG. 1 and more particularly described in U.S. Pat. No. 3,660,755 which issued May 2, 1972 to Janssen. Also as indicated in Janssen, each electrode pair is shortcircuited by insulated conductors 93, 94, 95, and 97 respectively, the purpose of which has been more fully explained in the abovementioned Janssen patent. As will be hereinafter explained, the central electrode $A_O$ and the shorted pairs extending longitudinally outward therefrom are connected to the resistivity logging electronics 4 by conductors 57, 56, 55, 54, and 53 respectively. Additionally, and again the purpose of which will be hereinafter explained, subsurface electronics 4 is provided with a deep log remote current return conductor 52 attached to the armored sheathing of cable 18 and with a remote potential reference conductor 50 or 50A extending therefrom to a remote potential reference point 51 located on the earth's surface 10.

Referring now to FIG. 3, a schematic representation of the electronic circuits making up the resistivity electronics 4 is shown. A current transformer 60 is positioned to sample the current excitation supplied central electrode $A_O$ over conductor 57. The secondary coil 62 of transformer 60 is connected across the inputs of an amplifier 64 with the output thereof coupled into two conventional band pass filters 66 and 68. Band pass filter 66 is designed to pass a first preselected freauency $f_1$ and band pass filter 68 to pass a second preselected frequency $f_2$. The signals at frequencies $f_1$ and $f_2$ developed in filters 66 and 68 are then coupled into phase-sensitive detectors 70 and 72 respectively. Phase-sensitive detector 70 produces a DC voltage signal $V_{1D}$, which is functionally related to the current sensed by transformer 60 at frequency $f_1$. Phase-sensitive detector 72 similarly produces a DC voltage signal, $V_{1S}$, which is funcitonally related to the current sensed by transformer 60 at frequency $f_2$. Voltage signals $V_{1D}$ and $V_{1S}$ are thereafter coupled into a sequencer 99 through conductors 103 and 101 respectively, and thereafter delivered to the telemetry section 3 as log information signal 23.

Electrode pair $M_1$—$M_1'$ is connected to one input of an amplifier 80 with the second input connected by conductor 50 or 50A to the remote potential reference probe 51 situated on the earth's surface 10 through telemetry cables 15 and 17 in logging cable 18. The output of amplifier 80 is coupled into a second pair of conventional band pass filter 84 and 86, with filter 84 designed to pass signals at frequency $f_1$ and filter 86 designed to pass signals at frequency $f_2$. The $f_1$ and $f_2$ signals thus passed are coupled into phase sensitive detectors 88 and 90 respectively. Detector 88 develops a voltage signal $V_{2D}$ having an amplitude functionally related to the potential, at frequency $f_1$, developed between measure electrodes pair $M_1$—$M_1'$ and the remote potential reference 51. Detector 90 develops a voltage $V_{2S}$ having an amplitude functionally related to the potential at frequency $f_2$, developed between measure electrodes pair $M_1$—$M_1'$ and the remote potential reference 51. Signals $V_{2D}$ and $V_{2S}$ are coupled into the sequencer 99 through inputs 105 and 107 respectively. The signals are then encoded, as were the signals from detector 70 and 72, for transmission over telemetry cables 15 and 17 forming a part of logging cable 18, and coupled into the well site system 1.

Voltage signal $V_{2D}$ is additionally coupled into one input of an amplifier 96 with the remaining input thereof connected to a first DC reference voltage source 100 such that $V_{2D}$ and the DC voltage are linearly combined. The combined signal is then passed through a chopper 102 to derive a square wave signal at frequency $f_1$. The square wave signal is thereafter coupled into a narrow band pass filter 104 which extracts the fundamental of the square wave signal to produce a sinusoidal drive signal at frequency $f_1$. Drive signal, $f_1$, is impressed across the primary coil 108 of a transformer 106 with the secondary coil 110 thereof having one output lead connected to an input of an amplifier 112 shown generally at 114. The outputs of current amplifier 114 are connected by conductor 52 to the remote current return forming the armored sheathing of logging cable 18 and current electrode pair $A_1$—$A_2'$. The output signal from current amplifier 114 is also coupled into current electrode pair $B_1$—$B_2'$ which are shorted to electrode pair $A_1$—$A_2'$.

Voltage signal $V_{2D}$ is also linearly combined in an amplifier 98 with a second DC reference voltage developed in source 116 and the resulting signal thereafter coupled through the chopper 118 to form a square wave signal at the frequency $f_2$. The square wave signal is then coupled through a narrow band pass filter 120 to extract a fundamental signal thereof to produce a sinusoidal drive signal which is coupled into one input of an amplifier 122. Amplifier 122 has an output connected to the remaining input in a feedback connection forming a voltage amplifier shown generally at 124. The outputs of amplifier 122 are coupled into electrodes $B_1$—$B_2'$ and electrodes $A_1$—$A_2'$ over conductors 53 and 54, respectively.

The output impedance of an operational amplifier connected as a voltage amplifier circuit is essentially zero, whereby, at frequency $f_1$, the voltage amplifier 124 acts as a shortcircuit allowing the current amplifier 114 to be connected simultaneously to $A_1$—$A_2'$ and $B_1$—$B_2'$ as above-mentioned. Further, an operational amplifier connected as a current amplifier circuit has a large, essentially infinite, output impedance, whereby amplifier 114 presents an open circuit between electrode pairs $A_1$—$A_2'$ and $B_1$—$B_2'$, connected to one output of amplifier 114, and the remote current return 52, connected to the remaining output of amplifier 114.

The remaining shorted pairs of electrodes, measurement electrode pairs $M_1$—$M_1'$ and $M_2$—$M_2'$, are respectively connected to an input of a high gain amplifier 82, the output of which is coupled through the primary coil 126 of transformer 60 into central electrode $A_O$, with currents $I_{1D}$ and $I_{1S}$ impressed through electrode $A_O$ into the surrounding formation at frequencies $f_1$ and $f_2$.

Referring now to FIG. 3, it is thus seen that the above-described interconnections provide for measurements of signals necessary to derive the apparent formation resistivity which have reduced dynamic ranges. As a result, the currents, $I_{1D}$ and $I_{1S}$, which are impressed into the formation from electrode $A_O$ and allowed to vary in accordance with changing resistivities of the formation to provide zero potential difference between shorted electrode pairs $M_1$—$M_1'$ amd $M_2$—$M_2'$, can be measured to develop voltage signals $V_{1D}$ and $V_{1S}$, which are respectively proportional to the abovementioned output currents. Voltages signals $V_{1D}$ and $V_{1S}$ are coupled into the analog multiplexer on conductors 103 and 101 respectively. Similarly, the potentials across the formation resistivities for both the deep and shallow measurements are sensed by shorted electrode pair $M_1$—$M_1'$ with the signal compared to the remote potential reference indicated at 51 in FIG. 1, to develop deep and shallow potentials $V_{2D}$ and $V_{2S}$, which are coupled into the analog multiplexer on conductors 105 and 107 respectively.

Sequencer 99 encodes the received voltages $V_{1S}$, $V_{1D}$, $V_{2S}$ and $V_{2D}$ transmits them, via telemetry cables 15 and 17 contained in logging cable 18, to the well site system 1 on the earth's surface, as shown in FIG. 1. The received signals are then decoded and processed in a manner to be described.

Referring now more particularly to the circuitry of the well site system 1 depicted in FIG. 4, it will first be noted that the purpose of the circuitry is to receive logging information over cable 18 from the sonde 16 for recording, display, analysis and the like, and to transmit information to the sonde 16 over cable 18.

In the particular embodiment depicted, the information transmitted downhole will include high level pulsed information instructing the transmitters and receivers of a conventional acoustic logging tool to "fire" or be enabled at preselected depth intervals in response to a depth command signal sent downhole. However, it will be appreciated that because a particular feature of the present invention concerns bi-directional transmission of pulsed or digital data in general, the invention is thus not intended to be limited in scope to situations involving only acoustic logging information sent downhole. Rather, it is within the scope of the present invention to include the transmission downhole in a general case of any pulsed data such as PCM data to a downhole microprocessor and the like.

In FIG. 4, there may be seen an acoustic logic generator 48, the purpose of which is to generate four pulses $P_1$–$P_4$ such as those depicted generally as the acoustic logic pulse train 87 in FIG. 5. This pulse train 87 is generated each time the generator 48 receives a depth interrupt signal 19 from the depth encoder 2 corresponding to the fact that the sonde 16 has reached a different preselected depth. The pulse train 87 will thereafter be delivered as acoustic logic pulse signal 59 to a conventional line driver 49 which serves to amplify the pulses and match the impedance of the generator to the conductive path to be described which it is driving.

After conditioning by the driver 49, the acoustic logic pulse signal 65 will then be delivered to the primary 76 of a suitable pulse or drive transformer shown generally as 67 in FIG. 4. Through transformer coupling to the secondary 75 of the transformer 67, the pulse train 87 will then be transmitted on the telemetry conductors 15 and 17 of logging cable 18 to the telemetry section 3 of the sonde 16.

It will further be noted in FIG. 4 that a power source 47 may be preferably provided at the well site system 1 for delivery of suitable power such as 60 Hz AC over power conductors 11 and 13 of cable 18 for purposes of providing power to the circuitry in the sonde 16. Referring to FIG. 7, there may be seen in more detail an isometric view with cross-section of a section of the logging cable 18. The cable 18 may preferably be of the multi-conductor type wherein an outer metallic protective armor sheaths or encloses seven insulated conductors C1–C7, six of which (C1–C6) are disposed in helical fashion about a centermost conductor C7. For reference purposes, it will be assumed that the hereinbefore described power conductors 11 and 13 will correspond to conductors C4 and C6 of FIG. 7. Accordingly, it is a feature of the present invention that the bi-directional pulsed data being transmitted between the well site system 1 and the sonde 16, as well as the low level signals to be described such as that of the remote potential reference conductor 50 or 50A, will be transferred over telemetry conductors 15 and 17 corresponding to conductors C2 and C5 of FIG. 7.

A feature of the present invention involves the relative position of the power conductors 11 and 13 with respect to the bi-directional telemetry conductors 15 and 17, whereby the latter lie substantially on a line which bisects, in turn, another line passing substantially through the centers of the power conductors 11–13. Thus, telemetry conductors C2–C5 lie on such a line bisecting a line connecting the centers of the power conductors C4–C6. The choice of conductor pairs C2–C5 and C4–C6, was thus arbitrary for purposes of illustration. It will therefore be apparent that other such power-telemetry conductor pairs fit the criteria, such pairs being (listing the power conductors followed by the telemetry conductors): C5–C1, C6–C3; C6–C2, C1–C4; C1–C3, C2–C5; C2–C4, C3–C6; C3–C5, C4–C1.

By placing power on the balanced conductor pair C4–C6, and by placing bi-directional pulsed data on conductors C2–C5, and further by placing low level signals in a center tap or phantom fashion also on the balanced conductor pairs C2–C5, several benefits are obtained. First, in the prior art, acoustic trigger logic pulses were typically sent downhole in unbalanced fashion, i.e. on one or more of the conductors C1–C7 referenced to the outer sheath or armor of the cable 18. In the present invention, the logic pulses are transmitted over a balanced transmission line or conductor pair such as C2–C5, "balanced" referring to (1) the fact that the conductor pair lies on the line bisecting the line passing through the center of the power conductors, and (2) the fact that the signal being carried on the conductor pair C2–C5 is carried differentially, meaning that with a signal on one conductor of the pair, a signal equal and opposite thereto in polarity appears on the other conductor as a common return path. Thus, in the present example, conductors C1–C3 would not be "balanced" with respect to conductors C4 and C6 for geometric reasons in that they would not lie on the bisecting line. Moreover, the conductor pair C1 and armor would not be "balanced" in that all signals carried on conductors in the cable 18 are referenced to the outer armor, and thus there can be no signal on the armor, as ground potential, equal and opposite in polarity to the signal carried by conductor C1.

Acoustic logic pulses are transmitted on the balanced conductor pair C2–C5 rather than transmitting receiver pulses on one conductor referenced to armor such as C1 and transmitter pulses on another conductor such as C3 referenced to armor, as was done in the prior art. By combining acoustic receiver and transmitter pulses on the same conductor pair, one conductor is thus saved and freed for additional signals. Moreover, by carrying such acoustic trigger pulses or other similar pulsed data on the balanced pair, rather than on one conductor referenced to armor, because the center conductor C7 is equidistant from both such conductors C2 and C5, crosstalk is substantially reduced from signals carried on C2–C5 into conductor C7, thus freeing conductor C7 to carry additional sensitive signals without risking interference from acoustic trigger pulses, PCM data, and the like carried on conductors C2–C5.

By the previously described conductor utilization of the present invention whereby acoustic trigger logic pulses in one direction and PCM data in the other direction are carried on the same balanced conductor pair, conductors are freed for carrying additional signals not possible in the prior art. More particularly, previously acoustic trigger pulses were carried on one or more conductors referenced to armor such as C1 or C3 with PCM data being carried in the other direction on a balanced line C2–C5. With the combination of acoustic trigger logic pulses and PCM data on the same balanced line C2–C5, conductors such as C1 and C3 previously dedicated to acoustic trigger logic pulses are now freed for other uses.

Still further, because one low level sensitive signal such as the remote potential may now be carried on a center tap or phantom conductor of the balanced pair C2–C5 without requiring the previous dedication of a relatively noise free conductor such as C7 for this purpose, this sensitive low level signal is now relatively free from crosstalk from any other signal on any other balanced pair of the cable 18. Thus the conductor C7 may be freed for simultaneously transmitting other such sensitive signals such as the acoustic signature. Another such signal would include pulses having amplitudes related to energy levels of natural gamma radiation incident upon the radioactivity logging instrument 6.

Based upon the foregoing description, it may now be apparent the bi-directional digital telemetry of logging data may be thus achieved on only one balanced conductor pair 15–17 of a multi-conductor logging cable 18 whereby two transmitter/receiver pairs are connected to the same conductors 15–17 without the surface receiver 71 erroneously decoding surface generated acoustic logic pulse trains 87 as if they were logging data generated in the sonde 16. In like manner, it may now be seen that the downhole acoustic logic decoder 31 is thus prevented from decoding logging data in the form of PCM frames 89 being transmitted to the surface on the same conductor pairs 15–17 as if they were acoustic logic pulse trains 87 so as to erroneously fire acoustic transmitters and receivers in instrument 8 in response thereto.

Referring now to FIG. 4, there will be seen a center tap hereinafter referred to as the remote potential conductor 50 connected at one end to the electrical center of the secondary 75 of the transformer 67. The other end thereof may be seen to be connected at an appropriate place on the earth's surface 10 to a remote potential reference point 51 for purposes of transmitting this potential reference with respect to the sonde 16 downhole in a manner to be described. In an alternative and preferred embodiment, there may further be seen in FIG. 4 a pair of equal value, high precision resistors 77 and 78 wired in series across the secondary 75, the junction point of the resistors 77–78 being connected to the alternate remote potential conductor 50A, the other end of which is in like manner to remote potential conductor 50 connected to a probe in the remote potential point 51 of the earth's surface 10.

Referring again to FIG. 4 in further detail, a similar center tap arrangement, or, in the alternative, resistive network, will be seen with the correlative remote potential conductors 50 or 50A delivering the signal carried thereupon (the potential at location 51 with respect to the sonde 16) to the amplifier 80 of the resistivity logging electronics 4 of FIG. 3 for purposes previously described. Specifically, in FIG. 2 one end of the remote potential conductor 50 will be interconnected to the amplifier 80, with the other end being connected as a center tap to the electrical center of the secondary 43 of the transformer 45. In the alternative and preferred embodiment, a resistive network comprised of resistors 45 and 46 wired in series will be interconnected across the secondary 43 of the transformer 43, with one end of the alternative remote potential conductor 50A being interconnected to the junction of these resistors 45–46. The other end of the alternative remote potential conductor 50A will, in like manner to conductor 50, be delivered to the amplifier 80. As with the resistors 77–78, the resistors 45–46 will also be high precision equal value matched resistors, preferably equal in value to those of resistors 77–78 and on the order of 1 kilohm.

Several things may be noted by the center tap arrangement of the remote potential conductors 50 or 50A with respect to the transformers 33 and 67 and the resistive networks 45–46 and 77–78. First, it will be noted that the remote potential reference at 51 relative to the sonde 16 and typically on the order of a few millivolts, has thus been transferred to the sonde 16 over a "phantom" conductor which is a balanced transmission line comprised of telemetry conductors 15–17. It has previously been thought that such sensitive signals, particularly when being transmitted simultaneously with other noise inducing signals such as acoustic logic pulse trains 87 and PCM data 89 on adjacent conductors in a multi-conductor logging cable such as 18 of FIG. 7 must be transmitted over the notoriously noise free center conductor C7. Moreover, it was thought that such signals could not be sent simultaneously with the hereinbefore noted radiation pulses. While the conductor C7 corresponding to conductor 9 of FIG. 1, in fact, is relatively immune to noise from other adjacent conductors due to its geometric placement in the center of cable 18, it will be appreciated that the center conductor 9 in the embodiment just described no longer must be dedicated to transmitting the remote potential reference at 51, and is freed to carry other sensitive signals such as the radiation pulses, thus increasing the amount of information which may be carried over the cable 18.

Moreover, because of the cable utilization thus described, a low level signal such as the remote potential reference carried on a phantom conductor of the balanced pair C2–C5 in a manner just described, is thus relatively free from crosstalk from any other signal on any other balanced pair in the conductor 18. Still further, as previously noted, because the acoustic logic trigger pulses P1–P4 or other such high level pulsed data is being carried on a balanced conductor pair such as C2–C5, crosstalk therefrom into the center conductor C7 (which will continue to carry other low level noise sensitive signals) will thus be substantially reduced.

Many modifications and variations besides those specifically mentioned may be made in the techniques and structures described and depicted in the accompanying drawings without departing substantially from the concept of the present invention. Accordingly, it should be clearly understood that the forms of the invention described and illustrated herein are exemplary only, and are not intended as limitations on the scope of the present invention.

What is claimed is:

1. Apparatus for investigating the subsurface earth materials traversed by a logging sonde along a borehole, comprising a logging sonde, surface telemetry means for generating and receiving logging information signals, said surface telemetry means comprised of first generator means for generating first pulsed acoustic logic logging information signals at said surface and first pulse receiver means for receiving second pulsed logging information signals from said sonde, subsurface telemetry means disposed within said sonde for said generating and receiving logging information signals, said subsurface telemetry means comprised of second pulse generator means for generating digital pulse code modulated signal as said second signals at said sonde, second pulse receiver means for receiving said first signals, and transmission means comprised of first conductor means electrically connected between said surface and subsurface telemetry means for transmitting pulsed signals correlative to said first and second signals between said surface telemetry means and said subsurface telemetry means, and second conductor means for simultaneously transmitting a low level analog potential signal as a third logging signal between said surface telemetry means and said subsurface telemetry means.

2. The apparatus of claim 1, wherein said transmission means further comprises a center conductor and at least two outer helical conductors disposed about said center conductor.

3. The apparatus of claim 2, wherein said first conductor means comprises said at least two outer conductors, and said second conductor means comprises a phantom utilizing said at least two outer conductors.

4. The apparatus of claim 2, wherein said first conductor means comprises said at least two outer conductors, and said second conductor means comprises said center conductor.

5. The apparatus of claim 1, wherein said first generator means further comprises acoustic logic generator means for generating acoustic logic control pulses and wherein said sonde further comprises an acoustic transmitter means for delivering acoustic energy into said formation adjacent said sonde in response to said acoustic logic control pulses, and an acoustic receiver means for receiving said acoustic energy in response to said acoustic logic control pulses.

6. The apparatus of claim 5, wherein said first pulsed logging information signals are said acoustic logic control pulses.

7. The apparatus of claim 3 or 4, wherein said at least two outer conductors are balanced.

8. The apparatus of claim 1, further including gating means interconnected to said transmission means for transmitting said first signals during a first time interval and said second signals during a second different time interval.

9. The apparatus of claim 1, further including third conductor means for transmitting fourth logging signals between said surface telemetry means and said subsurface telemetry means.

10. The apparatus of claim 1, wherein said first signals are acoustic logic pulses, said second signals are digital pulse code modulated signals, said third signal corresponds to the earth's potential at a location on said surface with respect to said sonde, and said second conductor means comprises a first center tap transformer means interconnected between said surface telemetry means and said first conductor means and second center tap transformer means interconnected between said subsurface telemetry means and said first conductor means.

11. The apparatus of claim 9, wherein said first signals are acoustic logic pulses, said second signals are digital pulse code modulated signals, said third signal corresponds to the earth's potential at a location on said surface with respect to said sonde, said second conductor means comprises a first center tap transformer means interconnected between said surface telemetry means and said first conductor means, and second center tap transformer means interconnected between said subsurface telemetry means and said first conductor means, and said fourth signals are comprised of radiation pulses having amplitudes corresponding to energy levels of atomic particles incident upon said sonde.

12. The apparatus of claim 11, wherein said first and second conductor means comprise at least two outer helical conductors, and said third conductor means comprises a center conductor disposed within said helical conductors.

13. The apparatus of claim 12, wherein said fourth signal is further comprised of said radiation pulses during a first preselected time interval and an acoustic signature signal indicative of acoustic energy within said borehole during a second preselected time interval.

14. The apparatus of claim 12, wherein said two outer helical conductors are disposed in diametrically opposed relation with respect to said center conductor.

15. Apparatus for investigating the subsurface earth materials traversed by a logging sonde along a borehole, comprising a logging cable comprised of a pair of helical conductors, at least one additional conductor, and a protective armor disposed about said conductor pair and said at least one additional conductor, a surface line transformer having a primary and secondary winding, a subsurface line transformer having a primary and secondary winding, said conductor pair being connected at one end to said secondary of said surface transformer and at the other end to said secondary of said subsurface transformer, depth encoder means for generating electrical indications of the location of said sonde at preselected depths within said borehole, acoustic pulse generator means interconnected to said primary of said surface transformer for generating an acoustic pulse train in response to said electrical indications, acoustic logging instrument means disposed within said sonde for transmitting into and receiving from said borehole acoustic energy in response to said acoustic pulse train, said acoustic instrument means having an output interconnected to one end of said at least one additional conductor, acoustic receiver means connected to the other end of said at least one additional conductor for receiving said output of said acoustic instrument means, acoustic logic decoder means interconnected between said primary of said subsurface transformer and said acoustic instrument means for detecting said acoustic pulse train at said primary of said subsurface transformer, at least on additional logging instrument means disposed within said sonde for deriving a logging measurement, a pulse code modulated transmitter means having an output connected to said primary of said subsurface transmitter, a first input connected to said at least one additional instrument means, and a second input connected to said logic decoder means, for deriving from said at least one additional instrument means and transmitting to said primary of said subsurface transmitter in response to said second input a digital pulse code modulated data frame of said logging measurement, said pulse code modulated transmitter means further including pulse code modulation sync generator means interconnected to said output of said pulse code modulated transmitter means for generating a digital sync word immediately preceding transmission of said frame of data identifying said transmission as said frame of data, pulse code modulation receiver means for receiving and decoding said pulse code modulated data frame, and sync detector means interconnected between said pulse code modulation receiver means and said primary of said surface transformer for detecting said sync word and passing said pulse code modulation data frame from said primary of said surface transformer to said pulse code modulator receiver in response to said detection.

16. The apparatus of claim 15, further comprising low level potential source located at said surface, first center tap means interconnected between said potential source and the electrical center of said primary of said surface transformer, low level receiver means located within said sonde for monitoring said potential source, and second center tap means interconnected between said low level receiver and the electrical center of said primary of said subsurface transformer.

17. The apparatus of claim 16, wherein said low level source includes remote potential probe means for detecting the potential of said surface relative to said sonde.

18. The apparatus of claim 15, further including first resistance having value R connected in parallel across said primary of said surface transformer, low level potential source located at said surface, first output tap means interconnected between said potential source and said first resistance at a first point on said first resistance wherein resistance at either end of said primary of said surface transformer with respect to said first point is R/2, second resistance having said value R connected in parallel across said primary of said subsurface transformer, low level receiver means located in said sonde, and second output tap means interconnected between said low level receiver and said second resistance at a second point on said second resistance wherein resistance at either end of said primary of said subsurface transformer with respect to said second point is said R/2.

19. The apparatus of claim 18, wherein said at least one additional conductor is disposed at the approximate center of the helix formed by said conductor pair.

* * * * *